United States Patent [19]

Drummond

[11] 4,337,411

[45] Jun. 29, 1982

[54] APPLICATION OF INSULATION TO RIDE FRAME OF VACUUM FLUORESCENT DISPLAY

[75] Inventor: Robert A. Drummond, Hazleton, Pa.

[73] Assignee: McGraw-Edison Company, Rolling Meadows, Ill.

[21] Appl. No.: 138,899

[22] Filed: Apr. 10, 1980

[51] Int. Cl.[3] ..... H01J 1/62; H01J 63/04

[52] U.S. Cl. ..... 313/497

[58] Field of Search ..... 313/496, 497, 268, 348

[56] References Cited

U.S. PATENT DOCUMENTS

| | | | |
|---|---|---|---|
| 4,132,920 | 1/1979 | Kobayakawa et al. | 313/497 |
| 4,214,025 | 7/1980 | Nixon | 313/497 |
| 4,223,244 | 9/1980 | Kishino et al. | 313/497 |

*Primary Examiner*—Bruce C. Anderson

*Attorney, Agent, or Firm*—Ronald J. LaPorte; Jon Carl Gealow

[57] ABSTRACT

The invention relates to vacuum fluorescent devices having a grid element positioned between the filament and fluorescent anodes of the device. An insulating material on a portion of the grid is effective to reduce grid current and to enable achievement of greater brightness of fluorescence from the fluorescent anodes.

15 Claims, 1 Drawing Figure

APPLICATION OF INSULATION TO RIDE FRAME OF VACUUM FLUORESCENT DISPLAY

BACKGROUND OF THE INVENTION

Figure 1:
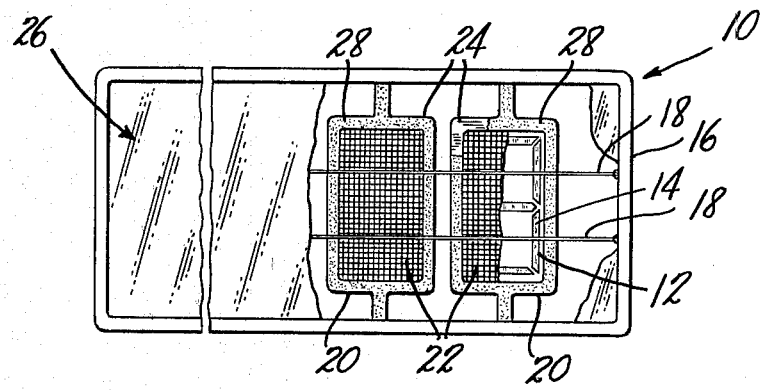

The invention relates to vacuum fluorescent devices and particularly to those vacuum fluorescent devices having a grid element positioned between a filament and the anodes of the device. The anodes of the device are coated with a fluorescent material so that when excited by bombardment of electrons, the fluorescent material will emit visible light. The brightness of the emitted light from the phosphor is dependent upon the anode current and acceleration potential between the filament and the anode. In these devices, the grid element is disposed between the filament, acting as a hot cathode, and the anode to control the flow of electrons from the cathode to the anode and emission of light from the fluorescent anode. The electric circuit is such that the grid is given a positive potential in order to provide an accelerating potential for electrons passing through the grid to the anode.

Many of the vacuum fluorescent devices are manufactured for use in a high brightness environment. The maximum brightness available from the device limited by the electrical current drive capabilities of commercially available integrated circuits. Thus a tradeoff has been made in the prior art devices between the desired maximum brightness level and the drive currents available to provide the emission of the fluorescent light.

SUMMARY OF THE INVENTION

It has been discovered that an insulating or a partially insulating coating on the frame of the grid, which is used only for support, will increase the brightness of the fluorescent anodes in a given vacuum fluorescent device.

The insulating material or partially conducting material may be brushed, sprayed, printed, silk-screened, or evaporated onto the grid frame using any of the techniques well known in the art which will enable its adherence to the grid frame. In addition, the material may be formed separately and mounted on the frame by fusing or other techniques known to persons skilled in this art.

The term grid control material used hereinafter in the specification and claims shall mean the insulating material or the insulating but partially conductive material referred to hereinabove.

While the increase in brightness achieved by the application of the grid control material of the present invention to the grid may result from a number of parameters, it is believed that the grid control material reduces the area of the grid 'observed' by the electrons that pass from cathode to anode and as a result more electrons emitted by the cathode will pass through the grid to the anode to give greater brightness. Passage of a greater number of electrons from the cathode through the grid to anode also tends to reduce the grid current and increase the anode current for greater brightness. Best results are achieved by applying the grid control material to the frame of the grid which is used only as a support but in certain applications the grid control material may be applied to other portions of the grid if desired for a particular result.

Further advantages of the grid control material of the present invention include greater brightness of the fluorescent anodes at lower grid current which results in reduced running temperatures by reducing $I^2R$ heating of the grid. The total input of power to the device may be reduced while brightness of the fluorescent anode is increased or the brightness may be comparable to prior art devices and give an even further reduction in the input of power.

The maximum output current level of existing drive electronics is presently approximately 8 millimaps. One of the critical factors in the geometry of previous vacuum fluorescent devices is the cathode-grid-anode spacing. To achieve the highest brightness levels of the fluorescence at the anodes, the grid is placed as near to the filament as possible. The grid current, however, increases as the grid is positioned nearer to the filament. The grid current level must remain less than the current limits imposed by the electronics. Thus it is a further object of the invention to provide less criticality in the geometry of the spacing so that the higher brightness may be maintained with a greater margin between the nominal operating grid current and the limits imposed by the electronic drive circuits.

Finally in the prior art devices, the grid potential is usually provided by a multiplexed signal, that is, each of the grids in the device time-share the control signal because the current limitations of the electronics preclude an individual direct control signal to each of the grids. Thus another object of the invention is to increase the feasibility of direct drive devices which might enable substantial reduction of the complexity of the drive circuitry of existing vacuum fluorescent devices.

It will be understood that the present invention is not limited to a vacuum display device with enhanced brightness since the foregoing advantages are achieved although the brightness of fluorescent anodes may be constructed to be the same as in prior art devices.

While the scope of the invention is not to be limited by following expanded theory of operation, it is set forth herein in order that the description of the features of the invention may be more completely understood.

It is conjectured that the reason for the reduction in grid current is as follows: It is known that the hot cathode emits electrons in the direction of the positively charged anodes, under the control of the grid. Since the grid is positively charged, some of the electrons which would ordinarily strike the anodes without the grid in place are absorbed by the grid. The number of electrons per unit of time absorbed by the grid (grid current) is assumed to correspond to an "effective" or "observed" cross-sectional area. When the frame of the grid is insulated by applying grid control material of the present invention thereto, the cross-sectional area "observed" by the electrons from the filament is significantly reduced. Since more electrons pass through the grid to the anode than was formerly the case, the result is a lower grid current and a higher anode current.

Further features of the invention will be apparent from the description of the drawing.

FIG. 1 is a front view of a vacuum fluorescent indicator with its transparent window partially broken to show a grid having the grid control material of the present invention applied thereto.

A vacuum fluorescent display according to the invention is shown in FIG. 1 generally at 10. One or more anodes coated with a fluorescent material are carried by an insulated substrate as is conventional in the art. FIG. 1 illustrates a plurality of conducting anodes 12 coated with a phosphor 14 mounted on a glass substrate 16.

Anodes 12 may be disposed in any desired format but for most applications they are typically arranged as a plurality of seven-segment characters for forming the digits of alpha-numeric display as illustrated in FIG. 1.

One or more cathode filaments are mounted above the anodes in conventional manner. In FIG. 1, two filaments 18 are shown mounted on the substrate 16 and positioned in front of the substrate 16 and positioned in front of and spaced away from the anodes 12.

As is conventional in the art, separate spaced grids may be positioned between the cathode and each separate anode or a single integral grid structure may be used for a plurality of anodes. In FIG. 1, a plurality of separate grids 20 are mounted on the substrate 16 and positioned between the anodes 12 and filaments 22. Each grid 20 includes a control portion 22 and a grid frame 24 supporting the control portion 22. The grid frame 24 is electrically conducting and is typically used both for support and for conducting electrical potential to the control portion 22.

A glass cover plate 26 is hermetically sealed to the substrate 16 in conventional manner as by use of a glass frit (not shown). The enclosure thus formed is evacuated and sealed so that the anodes, filaments, and grids can operate in a hard vacuum.

The various anodes 12, grids 20, and filaments 18 are connected to signal and potential sources (not shown) using well-known, conventional techniques for passing conducting leads through the substrate 16 or the hermetic seals between the cover 26 and substrate 16 (also not shown).

In prior art devices the distance between the filaments 18 and the grids 20 is critical. For high brightness fluorescence at the anodes, the grids 20 must be positioned as closely as possible to the filaments 22. If the grids 20 are too close to the anodes 16 the device will not meet desired maximum brightness specifications. But if the grids 20 are too close to the filaments 18, then the grid current becomes too high for conventional drive electronics (not shown).

According to the invention, the grid frame 24 is coated with a relatively thin coating of a grid control material such as magnesium hydroxide 28. This coating 28 forms a substantially-electrically-insulating layer between the filaments 18 and the grid frame 24. The choice of such insulating material is not limited to magnesium hydroxide and other materials may also be used. The grid control material may be magnesium oxide, or conductive inks, which are only partially insulating, and will also result in a reduction of grid current when applied to the grid frame 24. The grid control material may be applied in any convenient manner to all or only a portion of the grid frame and if desired the grid control material may be applied to the frame and to the grid control portion. Best results are achieved by coating the entire frame with grid control material.

In operation, using the insulated grid according to the invention, it is thought that the insulating coating 28 on the grid frame 24 insulates the large area of the grid frame from the electrons emitted by the filaments 18.

In the structure of FIG. 1, the ratio of grid current to anode current for lighting one of the digits without any coating of grid control material was 5.9 to 3.8. After the coating 28 of grid control material (magnesium hydroxide) had been applied to the frame 24, the ratio of grid current to anode current was 3.1 to 4.0 and the brightness of the fluorescent anode increased.

According to the present invention, the ratio of grid current to anode current which for a typical prior art device was *more* than one was reduced to *less* than one with the application of a coating of grid control material 28 to the grid frame 24.

It is to be understood that the invention is not to be limited to the preferred embodiment chosen herein for the purpose of description and the claims are intended to cover all changes and modifications of the preferred embodiments which do not constitute departures from the spirit and the scope of the invention.

What is claimed is:

1. A vacuum fluorescent device comprising:

(a) a substrate;

(b) at least one fluorescent anode carried by said substrate;

(c) a filament in spaced relationship to said anode for supplying electrons to said fluorescent anode;

(d) a grid element disposed between said filament and said fluorescent anode, for control of fluorescence of said anode, said grid element including a control portion and a grid frame, said grid frame supporting said control portion;

(e) a cover sealed to said substrate, enclosing said fluorescent anode, said grid element and said filament;

(f) the enclosure formed by said cover and said substrate being evacuated; and (g) grid control material applied to at least a portion of one of said control portion and grid frame on the side of said grid element nearest said filament, said grid control material being at least partially electrically insulating such that flow of electrons through the grid element increases the brightness of fluorescent light.

2. The vacuum fluorescent device of claim 1 wherein said grid control material is a partially conductive insulating material.

3. The vacuum fluorescent device of claim 1 in which the grid control material is magnesium hydroxide.

4. The vacuum fluorescent device of claim 1 wherein said grid control material is magnesium oxide.

5. The vacuum fluorescent device of claim 1 in which said grid control material is applied to said grid frame.

6. In a vacuum fluorescent device of the type having a fluorescent anode, cathode and a grid element adapted to control the current between the anode and cathode, said grid element including a control portion and a grid frame, said grid frame supporting said control portion, said anode, cathode, and grid element being enclosed in a hermetic enclosure, the improvement comprising: grid control material applied to at least a portion of one of said control portion and grid frame on the side of said grid element nearest said filament, said grid control material being at least a partial electrical insulator such that flow of electrons through the grid element in creases the brightness of fluorescent light.

7. The vacuum fluorescent device of claim 6 wherein said grid control material is an insulating material.

8. The vacuum fluorescent device as claimed in claim 5 wherein said grid control material comprises a coating of magnesium hydroxide.

9. The vacuum fluorescent device as claimed in claim 5 wherein said grid control material comprises a coating of magnesium oxide.

10. A vacuum fluorescent device as claimed in claim 6 wherein said grid control material is applied to said grid frame.

11. A vacuum fluorescent device as claimed in claim 10 wherein said grid control material comprises magnesium hydroxide.

12. A method of manufacturing a vacuum fluorescent device comprising the steps of:

(a) mounting a fluorescent anode on a substrate;

(b) mounting a grid on said substrate above said anode; said grid consisting of a grid frame and a grid control portion;

(c) coating said grid frame with a coating material which is at least a partial electrical insulator;

(d) mounting a filament above said grid;

(e) providing means for external electrical connections to said grid; said anode, and said filament;

(f) sealing a cover plate on said substrate, said cover plate and substrate enclosing said anode, said grid, and said filament; and (g) evacuating said enclosure.

13. The method of claim 12 wherein said coating is a partially electrical conductive material.

14. The method of claim 12 wherein said coating material is a substantially electrically insulating material.

15. The method of claim 12 wherein said coating material is magnesium hydroxide.

* * * * *